US007424045B2

(12) United States Patent
Wilcox et al.

(10) Patent No.: US 7,424,045 B2
(45) Date of Patent: Sep. 9, 2008

(54) METHOD AND APPARATUS FOR HEATING A WORKPIECE IN AN INERT ATMOSPHERE OR IN VACUUM

(76) Inventors: Dale R. Wilcox, 2116 Dublin Rd., Penfield, NY (US) 14526; Rick M. Vernon, 155 Burning Brush Dr., Rochester, NY (US) 14606

( * ) Notice: Subject to any disclaimer, the term of this patent is extended or adjusted under 35 U.S.C. 154(b) by 0 days.

(21) Appl. No.: 11/216,454

(22) Filed: Aug. 31, 2005

(65) Prior Publication Data

US 2006/0126700 A1 Jun. 15, 2006

Related U.S. Application Data

(60) Provisional application No. 60/606,457, filed on Sep. 1, 2004.

(51) Int. Cl.
*H05B 6/22* (2006.01)
*H05B 6/10* (2006.01)

(52) U.S. Cl. ..... 373/164; 373/150; 219/632; 219/635

(58) Field of Classification Search ..... 373/164, 373/162, 151; 219/632, 618, 623–624, 626–627, 219/634–635, 638, 650–651, 151; 204/298.16, 204/192.12; 432/77, 78, 81, 233; 164/122.1, 164/127, 361, 338.1
See application file for complete search history.

(56) References Cited

U.S. PATENT DOCUMENTS 4,774,992 A * 10/1988 George ..... 164/122.1
6,639,196 B1 * 10/2003 Fiala et al. ..... 219/632
2003/0209540 A1 11/2003 Dahake et al.

* cited by examiner

*Primary Examiner*—Quang T Van
(74) *Attorney, Agent, or Firm*—Brian B. Shaw, Esq.; Stephen B. Salai, Esq.; Harley Secrest & Emery LLP

(57) ABSTRACT

An induction furnace includes a cylinder, a top and bottom cover that seal the top and bottom ends of the cylinder, and coolant passages within the cylinder and the covers. The induction furnace further includes a power supply and a coil. The coil surrounds the chamber and is hollow to allow flow of coolant therethrough. A susceptor susceptible to induction heating is located in the chamber and includes top and bottom pieces. A thermal insulator is disposed between the susceptor and the inner walls of the chamber and can be formed of a fused quartz cylinder within which the susceptor and the workpiece are contained. The thermal insulator can also include infrared reflectors and insulating members on the ends of the susceptor to reduce heat leakage to parts of the furnace outside of the susceptor.

17 Claims, 5 Drawing Sheets

METHOD AND APPARATUS FOR HEATING A WORKPIECE IN AN INERT ATMOSPHERE OR IN VACUUM

CROSS-REFERENCE TO RELATED APPLICATIONS

This application is a conversion of U.S. Provisional patent application Ser. No. 60/606,457 filed Sep. 1, 2004, which is related to U.S. patent application Ser. No. 10/434-088 filed 9 May 2003 and published as U.S. Patent Application Publication No. US 2003/0209540 A1 on Nov. 13, 2003, which is related to U.S. Provisional patent application Ser. No. 60/378,648 filed May 8, 2002.

BACKGROUND AND SUMMARY

Embodiments relate to induction furnaces for heating a workpiece in an inert atmosphere or vacuum. In particular, embodiments employ various improvements to induction furnaces that allow less complex and less costly manufacture.

Conventional induction furnaces include an induction heating system and a chamber that contains a susceptor that is susceptible to induction heating. An electromagnetic coil sits outside the susceptor and receives high frequency alternating current from a power supply. The resulting alternating electromagnetic field heats the susceptor rapidly. The workpiece to be heated is placed in proximity to and generally within the susceptor so that when the susceptor is inductively heated by the induction heating system, the heat is transferred to the workpiece through radiation and/or conduction and convection. In a prior art system, a mating two-piece quartz chamber is employed as an insulation system. The top, bell-shaped piece of the chamber is fixed, while the bottom, bowl-shaped piece moves up and down with the stage on which the workpiece is placed. The chamber walls sit between the coil and the susceptor to substantially reduce heat leakage and improve heating efficiency. Thus, the mating two-piece quartz chamber arrangement provides insulation completely around the susceptor. While the quartz chamber excels at providing heat leakage insulation, it is somewhat costly to manufacture and somewhat fragile in nature. Thus, an alternative structure is desirable to decrease cost and improve durability.

An induction heating furnace employing the two-piece insulator described above is shown, for example, in FIGS. 1 and 2. The induction furnace 100 includes an induction heating system and a chamber 104 that comprises a quartz cylinder 110, a first cover 112 for sealing one end of the cylinder, and a second cover 114 for sealing the second end of the cylinder. The induction heating system includes a coil 120 and a power supply (not shown) that provides an alternating current that flows through the coil 120 during a heating cycle. The coil 120 is wound to form a cylindrical shape within the chamber 104, as shown in FIG. 1.

Contained within the chamber 104 is a susceptor 130 that is susceptible to induction heating. That is, when an alternating current flows through the coil 120, an alternating magnetic field is generated that induces eddy currents and other effects in the susceptor 130 that cause the susceptor 130 to heat. The thermal energy that radiates from the susceptor 130 is used to heat a workpiece 190. The susceptor 130 is shown as being cylindrical, but other shapes can be used. The susceptor 130 is made of any material susceptible to induction heating, such as, for example, graphite, molybdenum, steel, and tungsten. The susceptor 130 can be arranged within a thermal insulator 140 disposed substantially between the susceptor 130 and the inner walls of cylinder 110 in the chamber 104. The insulator 140 can be a cylindrical body 141 made from, for example, fused quartz. As shown in FIG. 1, insulator 140 can include additional fused quartz containers, such as a second fused quartz container 151.

The fused quartz container 141 can comprise two pieces: a first piece 142; and a second piece 144. The first piece 142 is connected to the first cover 112 of quartz cylinder 110 and the second piece 144 is connected to the second cover 114 of the quartz cylinder 110. Ceramic posts 161 can connect the first piece 142 to the first cover 112 and additional ceramic posts 162 can connect the second piece 144 to the second cover 114. A slight gap 164 between the first piece 142 and the second piece 144, such as of about 0.10 inches wide, can be employed to allow air to be evacuated from within the containers 141.

Similarly, the second fused quartz container 151 can comprise two pieces: a first piece 152; and a second piece 154. The first piece 152 is connected to the first piece 142 of the first container 141 and the second piece 154 is connected to the second piece 144 of the first container 141. As with the first container 141, a slight gap 166 between the first piece 152 and the second piece 154, such as of about 0.10 inches wide, can be employed to allow air to be evacuated from within the containers 141, 151. Preferably, as shown in FIG. 1, the gaps 164, 166 are not aligned to reduce heat leakage.

The susceptor 130 can also comprise two pieces: a first piece 132; and a second piece 134. The first piece 132 of the susceptor 130 is connected to the first piece 152 of the second container 151, and the second piece 134 of the susceptor 130 is connected to the second piece 154 of the second container 151. A tray 155 for supporting the workpiece 190 to be heated is connected to the second piece 134 of the susceptor 130. Although the susceptor 130 is shown as having closed ends, this need not be the case. For example, the susceptor 130 can be in the form of a tube that is open at both ends or, for example, it can comprise one or more susceptor sheets. At least one of the first and second covers 112, 114 is releasably connected to the quartz cylinder 110 so that the cover can be easily removed, thus providing a convenient mechanism for loading and unloading workpiece 190, as shown in FIG. 2.

The induction furnace 100 also includes a vacuum pump 170 for creating a vacuum within the chamber 104 and a cooling system 172 for cooling the chamber 104 after the workpiece has been heated as desired. The cooling system 172 can include a heat exchanger 174 and a blower 176. Hot air within the chamber 104 is drawn into the heat exchanger 174 and cooler air is blown back into the chamber 104 by the blower 174. To protect the vacuum pump 170, a gate or knife valve 178 can be interposed between the pump 170 and the chamber 104. The valve 178 shuts upon the beginning of the cooling cycle, thereby protecting pump 170.

Embodiments contemplate a new enclosure to further protect the surroundings from the extreme temperatures generated within the furnace while reducing costs and increasing efficiency. An annular enclosure is preferred, with its longitudinal axis normal to the ground or floor. Top and bottom covers are preferably employed to seal off the enclosure, though the bottom cover is preferably movable along the longitudinal axis of the enclosure to accommodate movement of the workpiece stage. Embodiments provide for cooling of the annular enclosure by circulation of water within the annular walls. Thus, a gap is formed between inner and outer walls of the annular enclosure and cooling water is pumped into the gap. Vanes are preferably formed in the gap to induce helical flow about the longitudinal axis of the enclosure, enhancing the cooling efficiency of the apparatus. In embodiments, a top cover seals the top end of the cylinder, and a bottom cover seals the bottom end of the cylinder, one or both of which can also be water cooled. The induction heating system includes a coil connected to a power supply. The coil surrounds the quartz cylinder, but lies within the steel cylinder. The susceptor lies within the fused quartz cylinder, as does the workpiece stage.

Advantageously, the susceptor comprises two pieces: an upper piece and a lower piece. The upper piece is connected to the top cover of the stainless steel cylinder and the lower piece is connected to the bottom cover and the stage. The bottom cover is releasably connected to the upper piece of the cylinder so that it can be easily removed, thus providing a convenient mechanism for loading and unloading the workpiece.

Additionally, embodiments employ susceptible materials for the wall of the outer housing of the furnace by arranging a distance between an inner wall and the induction coil within, as well as special selection of AC frequencies, to prevent electromagnetic field coupling of the wall. For example, embodiments can employ stainless steel, which is much less costly than quartz.

Another heat control arrangement involves the manner of construction of the coil. Preferably, the coil is hollow to allow cooling water to flow therein. Since the coil must conduct electricity, the coil must be made from a conductor, such as a conductive metal. Thus, the coil is preferably made from metal tubing, such as copper tubing.

A further heat control arrangement employed in embodiments is the formation of at least one insulative air gap at at least one end of the susceptor. Such an air gap is preferably formed between two discs separated by a spacer. While many materials could be used, graphite discs are preferred in embodiments. Additionally, ceramic or graphite rings are preferred as spacers between the discs. Graphite and ceramic materials are particularly hardy in the type of environment to which these parts are exposed and so enhance the life of the parts when used.

Still another heat control arrangement used in embodiments is the inclusion of one or more infrared radiation reflectors. In particular, a reflector can be placed at an end of the susceptor to reduce heat leakage from the end of the susceptor. This is particularly useful when a cylindrical fused quartz insulator is employed in the chamber, since the open ends of the quartz insulator do not provide insulation. Embodiments employ a disc at each end of the susceptor, preferably made from molybdenum or a similarly robust and infrared radiation reflective substance. Preferably, embodiments use at least one such reflector at each end of the susceptor: one can be mounted on the support of the susceptor, and another can be mounted on under the work piece stage, for example.

By special selection of the frequencies employed in the induction coil, a dual heating effect can be achieved in embodiments. For example, frequencies in a range of from about 8 kHz to about 10 kHz penetrate the insulation and couple into the susceptor material while also coupling into a conductive object being treated in the susceptor. The coupling into the treated object provides direct induction heating of the object in addition to radiational heating from the susceptor walls, increasing the efficiency of the furnace.

The above and other features of the present invention, as well as the structure and operation of preferred embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. Additionally, the left-most digit(s) of a reference number identifies the drawing in which the reference number first appears.

DESCRIPTION

While the present invention may be embodied in many different forms, there is described herein in detail an illustrative embodiment with the understanding that the present disclosure is to be considered as an example of the principles of the invention and is not intended to limit the invention to the illustrated embodiment.

Figure 1:
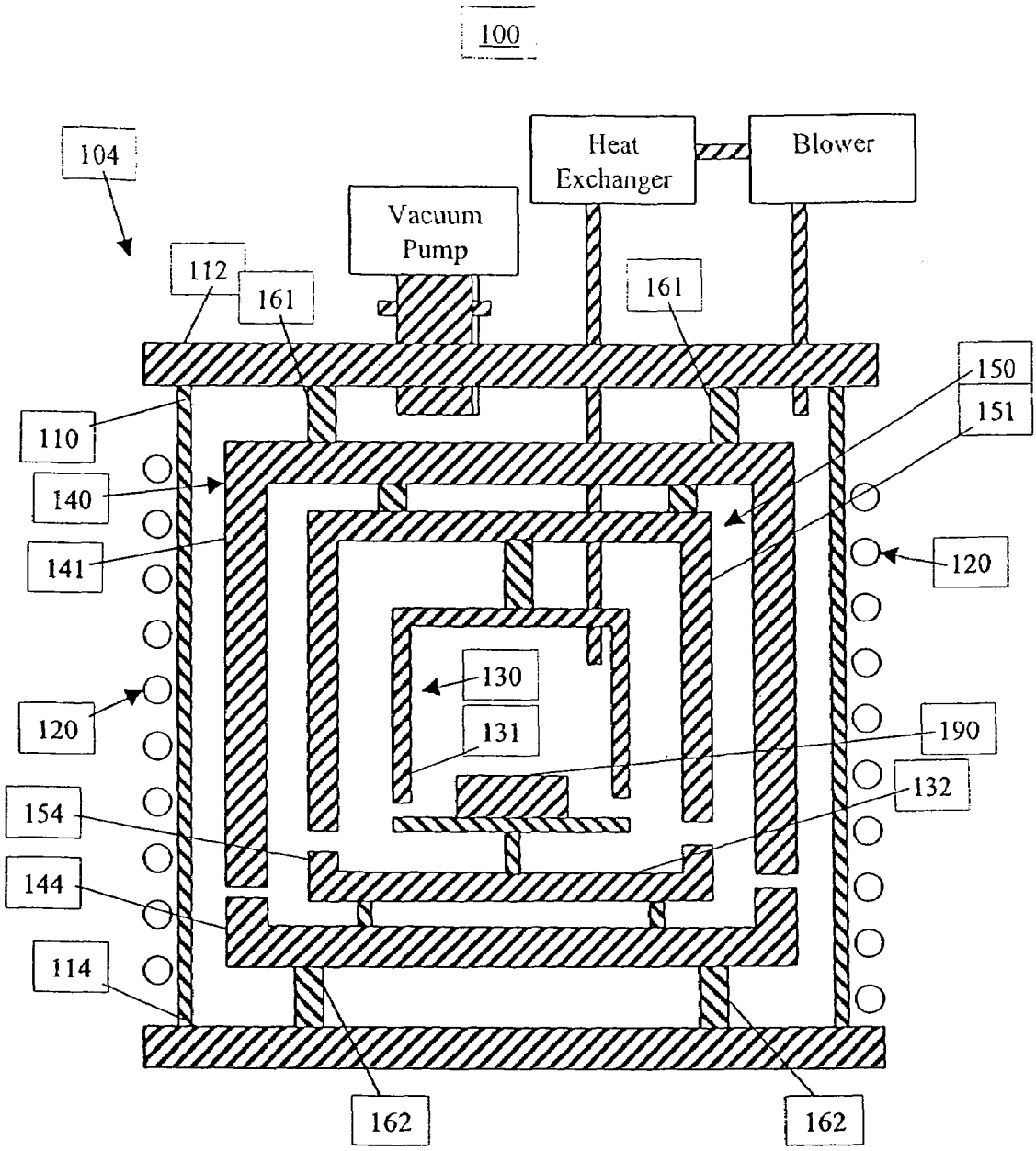
FIG. 1 is a schematic diagram of a cross section of a typical induction heating furnace to be improved.
Figure 2:
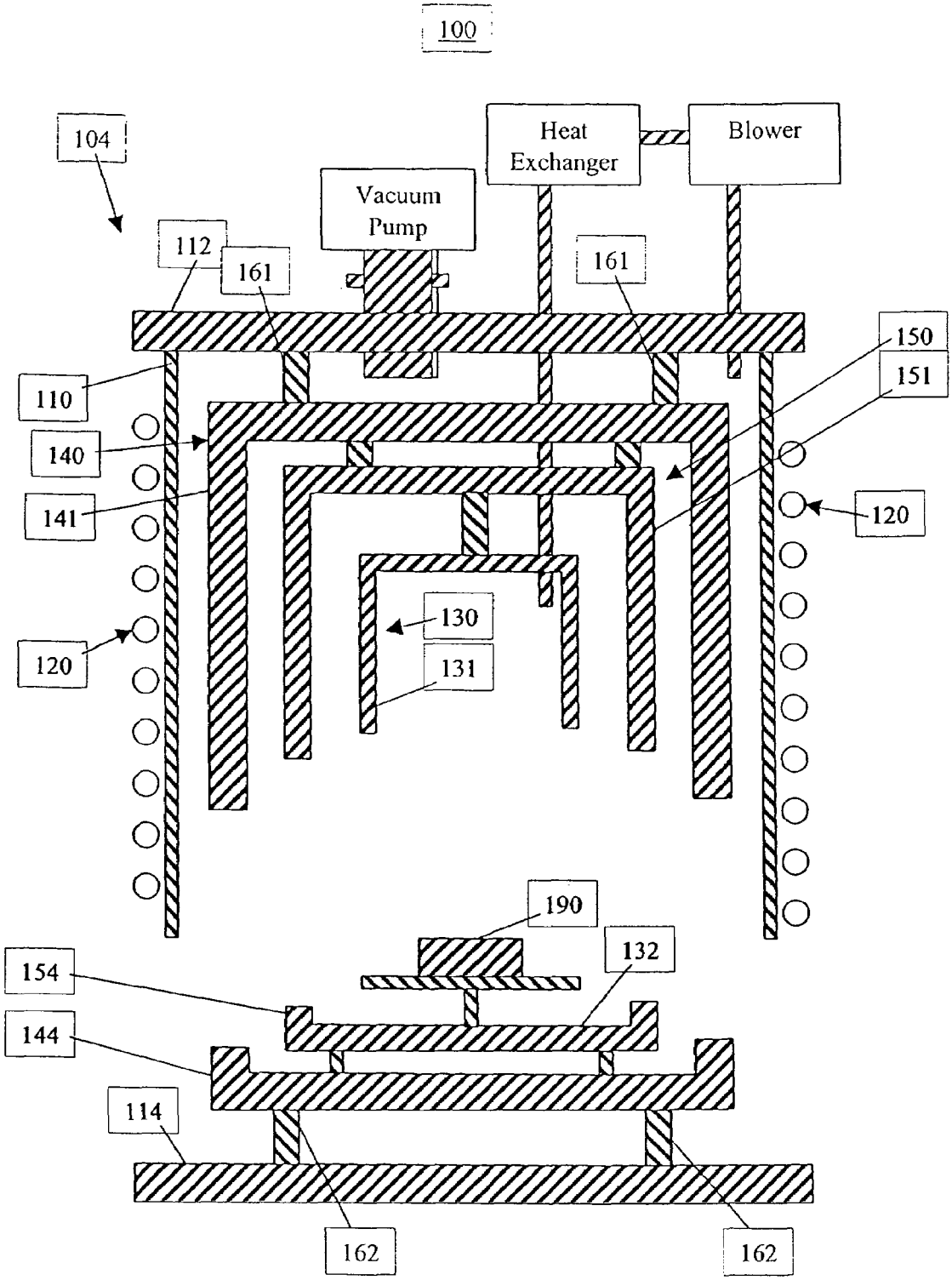
FIG. 2 is a diagram further illustrating the typical induction heating furnace to be improved.
Figure 3:
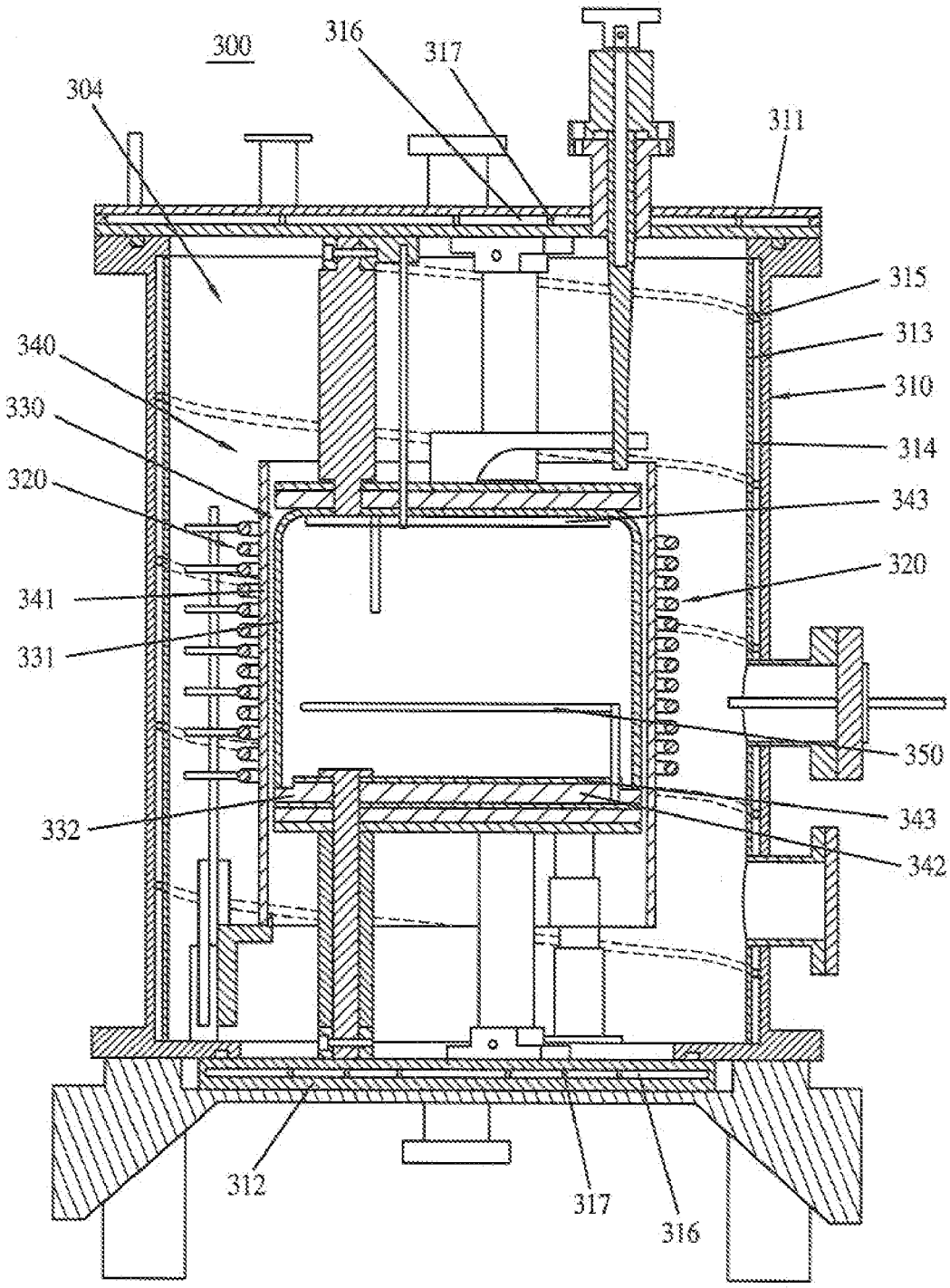
FIG. 3 is a cross sectional schematic diagram of an improved induction heating furnace of embodiments.

As seen, for example, in FIG. 3, embodiments provide an improved induction furnace 300 with a chamber 304 surrounded by a cylinder 310 with top and bottom covers 311 and 312. Preferably, the cylinder 310 is annular and includes an inner wall 313 and an outer wall 314 that form an annular gap therebetween. In addition, vanes 315 are preferably disposed within the annular gap, the function of which will be discussed below. Additionally, the covers 311, 312 preferably include cooling passages 316 and vanes 317.

Within the cylinder 310, an induction coil 320 surrounds a susceptor 330 that is disposed within an insulator 340. The induction coil 320 is preferably helical and hollow, allowing the flow of cooling water or other coolant therethrough. The susceptor 330 includes an upper piece 331 and a lower piece 332. At least the upper piece 331 should be formed from a susceptible material, such as graphite or the other materials suggested above. The upper piece 331 is suspended from the top cover 311 of the cylinder 310, and the lower piece 332 is supported by the bottom cover 312 of the cylinder 310. A stage 350 is disposed within the susceptor 330 to support a workpiece 190 to be heated. The upper piece 331 of the susceptor 330 can have a U-shaped longitudinal cross section to give the upper piece 331 a bell-shaped configuration.

When an alternating current flows through the coil 320, an alternating magnetic field is generated that induces eddy and/or other electrical currents in the susceptor 330. These currents in the susceptor 330 cause the susceptor 330 to heat. The resulting thermal energy radiates from the susceptor 330 and can heat a workpiece 190. Where an atmosphere is present within the susceptor 330, additional heat transfer can occur via convection and/or conduction. Preferably, the susceptor 330 is substantially cylindrical, but other shapes can be used. Susceptor 330 can be made of any material that is susceptible to induction heating, such as graphite, molybdenum, steel, tungsten, and other suitable materials. Preferably, the susceptor comprises graphite.

Figure 4:
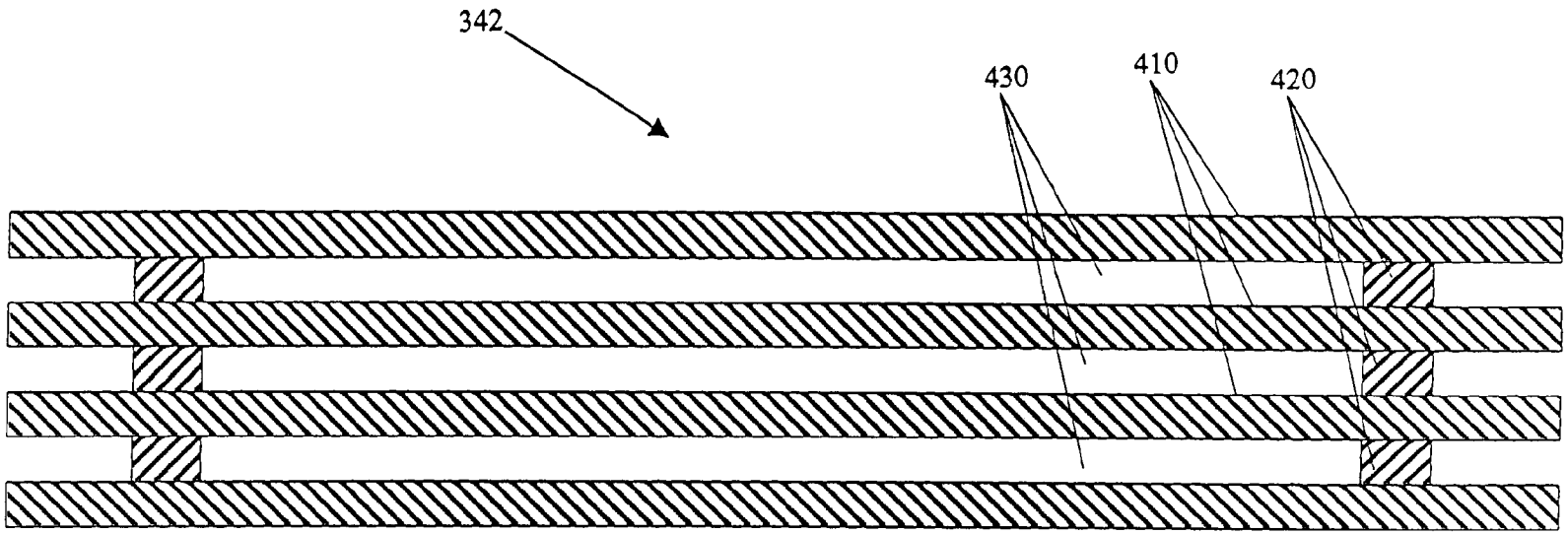
FIG. 4 is an enlarged view of an insulating component usable in embodiments.
Figure 5:
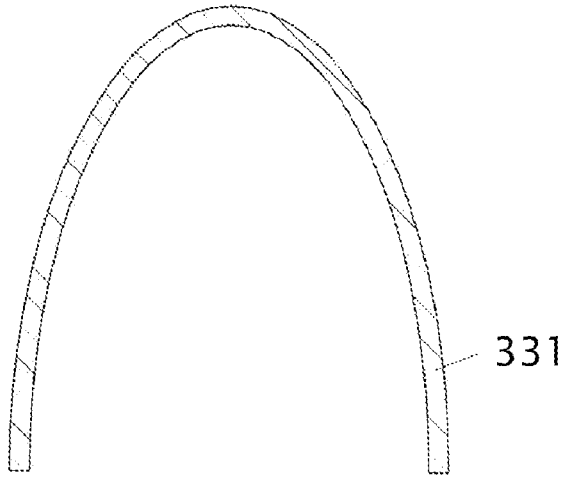
FIG. 5 is a cross sectional schematic diagram showing a bell shaped top piece of the susceptor.
Figure 6:
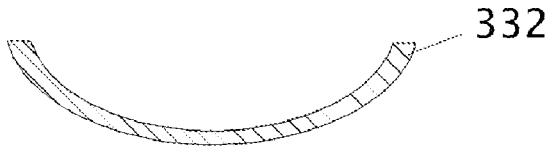
FIG. 6 is a cross sectional schematic diagram showing a substantially bow shaped bottom piece of the susceptor.

As mentioned above, the insulator 340 is disposed substantially between the coil 320 and the susceptor 330. The insulator preferably employs a simple cylinder 341 of, for example, quartz as the main insulative body between the coil 320 and the susceptor 330. To supplement the insulation provided by the cylinder 341, one or more end insulators 342 can be used. The end insulators 342 employ one or more air gaps 430, shown particularly in FIG. 4, each formed by two spaced-apart discs 410. Graphite or other forms of carbon are particulary hardy and are suitable for use in the discs 410. When the discs 410 are separated by rings 420 to form dead air space 430, the air provides excellent insulation. Multiple such air gaps 430 can be employed to enhance insulative capability. The rings 420 can be made from ceramics, graphite, or other suitable hardy materials.

Additionally, embodiments can employ one or more infrared radiation reflectors 343, made, for example, of molybdenum. Such reflectors 343 further reduce heat leakage and further enhance efficiency of the induction furnace 300. Preferably, embodiments use at least one such reflector 343 at each end of the susceptor 330: one can be mounted on the support of the susceptor on the upper piece 331 of the susceptor, and another can be mounted on the lower piece 332 of the susceptor 330 under the workpiece stage 350, for example.

The cylinder 310 described above represents a new enclosure preferably employed in embodiments to further protect the surroundings from the extreme temperatures generated within the furnace 300. The top and bottom covers 311, 312 preferably seal off the chamber 304, though the bottom cover 312 is preferably movable along the longitudinal axis of the enclosure to accommodate movement of the workpiece stage 350. Embodiments provide for cooling of the cylinder 310 by circulation of water or another suitable coolant between the inner and outer walls 313, 314. Vanes 315 are preferably formed in the gap to induce helical flow about the longitudinal axis of the cylinder 310, enhancing the cooling efficiency of the apparatus. One or both of the covers 311, 312 can also be water cooled by circulating water through cooling passages 316 that can also include vanes 317. Heated water is cooled by an external heat exchanging system, then returned to the gap for additional cooling of the cylinder 310.

By special selection of the frequencies employed in the induction coil 320, a dual heating effect can be achieved in embodiments. For example, frequencies in a range of from about 8 kHz to about 10 kHz penetrate the insulator 340 and couple into the susceptor 330 material while also coupling into a workpiece being treated in the susceptor 330. The coupling into the workpiece provides direct induction heating of the workpiece in addition to radiational heating from the susceptor walls, increasing the efficiency of the furnace.

As in prior systems, the induction furnace 300 can include a vacuum pump for creating a vacuum within the chamber 304 and a cooling system for cooling the chamber 304 after the workpiece has been heated as desired. The cooling system can include a heat exchanger and a blower. Hot air within the chamber 304 is drawn into the heat exchanger and cooler air is blown back into the chamber 304 by the blower. To protect the vacuum pump, a gate or knife valve can be interposed between the pump and the chamber 304. The valve shuts upon the beginning of the cooling cycle, thereby protecting pump.

While various illustrative embodiments of the present invention described above have been presented by way of example only, and not limitation, it will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. An induction heating furnace, comprising:
(a) an outer cylinder with first and second ends;
(b) first and second covers that seal the first and second ends of the outer cylinder, respectively;
(c) a thermal insulating cylinder within the outer cylinder;
(d) a coil within the outer cylinder, the coil surrounding the insulating cylinder;
(e) a susceptor within the insulating cylinder, the susceptor susceptible to induction heating, wherein the susceptor includes a top piece, the top piece having an end wall suspended from one of the outer cylinder covers; and
(f) an infrared reflector mounted on an inner surface of the end wall.

2. The induction heating furnace of claim 1 wherein the susceptor includes a bell shaped top piece.

3. The induction heating furnace of claim 1 wherein the susceptor includes a substantially cylindrical top piece.

4. The induction heating furnace of claim 1 wherein the end wall is not susceptible.

5. The induction heating furnace of claim 1 wherein the susceptor further includes a bottom piece.

6. The induction heating furnace of claim 5 wherein the bottom piece is substantially bowl-shaped.

7. The system of claim 5, wherein the susceptor is cylindrical in shape.

8. The induction heating furnace of claim 1 further comprising at least one thermally insulating member disposed between at least one end of the susceptor and a respective outer cylinder cover.

9. The induction heating furnace of claim 1 wherein the thermal insulating cylinder is quartz.

10. An induction heating furnace, comprising:
(a) an outer cylinder with first and second ends;
(b) first and second covers that seal the first and second ends of the outer cylinder, respectively;
(c) a thermal insulating cylinder within the outer cylinder;
(d) a coil within the outer cylinder, the coil surrounding the insulating cylinder;
(e) a susceptor within the insulating cylinder, the susceptor susceptible to induction heating; and
(f) at least one thermally insulating member disposed between at least one end of the susceptor and a respective outer cylinder cover, wherein each thermally insulating member comprises a pair of discs separated by a spacer to form a substantially stationary pocket of gas between the discs.

11. The induction heating furnace of claim 10 wherein the discs comprise a susceptible material.

12. The induction heating furnace of claim 11 wherein the discs comprise graphite.

13. The induction heating furnace of claim 10 wherein the spacer comprises a ceramic material.

14. The induction heating furnace of claim 10 wherein the at least one thermal insulating member is located outside of an induction field provided by the coil.

15. The induction heating furnace of claim 10 wherein the outer cylinder comprises a susceptible material.

16. The induction heating furnace of claim 15 wherein the susceptible material is steel.

17. The induction heating furnace of claim 15 wherein the outer cylinder is spaced apart from the coil so that the cylinder is substantially free from coupling of an induction field provided by the coil.

* * * * *